US009937933B2

(12) United States Patent
Basily et al.

(10) Patent No.: US 9,937,933 B2
(45) Date of Patent: Apr. 10, 2018

(54) HIGH LEVEL PLATFORM TRAPDOOR WITH BUILT IN MOVING SLIDE FOR RAILWAY PLATFORM GAP BRIDGING

(71) Applicant: RUTGERS, THE STATE UNIVERSITY OF NEW JERSEY, New Brunswick, NJ (US)

(72) Inventors: Basily B. Basily, Piscataway, NJ (US); Thomas O. Boucher, Glen Ridge, NJ (US)

(73) Assignee: RUTGERS, THE STATE UNIVERSITY OF NEW JERSEY, New Bruswick, NJ (US)

( * ) Notice: Subject to any disclaimer, the term of this patent is extended or adjusted under 35 U.S.C. 154(b) by 0 days.

(21) Appl. No.: 14/364,086

(22) PCT Filed: Dec. 17, 2012

(86) PCT No.: PCT/US2012/070167

§ 371 (c)(1),
(2) Date: Jun. 10, 2014

(87) PCT Pub. No.: WO2013/090920

PCT Pub. Date: Jun. 20, 2013

(65) Prior Publication Data

US 2014/0352572 A1 Dec. 4, 2014

Related U.S. Application Data

(60) Provisional application No. 61/576,682, filed on Dec. 16, 2011.

(51) Int. Cl.

| | |
|---|---|
| ***B61D 23/00*** | (2006.01) |
| ***B61D 23/02*** | (2006.01) |
| ***B61D 17/00*** | (2006.01) |

(52) U.S. Cl.
CPC ..... *B61D 23/00* (2013.01); *B61D 17/00* (2013.01); *B61D 23/025* (2013.01)

(58) Field of Classification Search
CPC .. E04F 2011/005; E04F 11/002; B61D 23/02; B61D 19/02; B61D 23/025; B61D 23/00;
(Continued)

(56) References Cited

U.S. PATENT DOCUMENTS

| | | | |
|---|---|---|---|
| 2,522,674 | A | 9/1950 | Heyerdahl |
| 3,924,545 | A | 12/1975 | Anders et al. |

(Continued)

FOREIGN PATENT DOCUMENTS

| | | |
|---|---|---|
| KR | 1020050121688 | 12/2005 |
| KR | 1020090034232 | 4/2009 |

OTHER PUBLICATIONS

International Search Report issued in PCT/US12/70167 dated Apr. 22, 2013.

*Primary Examiner* — Mark T Le
(74) *Attorney, Agent, or Firm* — Stephen H. Eland; Dann, Dorfman, Herrell & Skillman

(57) ABSTRACT

A trapdoor assembly for use on railcars is provided. The trapdoor assembly is pivotable between an up position and a down position. In the up position, the trapdoor assembly provides access to stairs on the railcar so that passengers can egress between the railcar and a ground level platform at a rail station. In the down position, the trapdoor assembly covers the stairs and provides a platform so that passengers can egress between the railcar and an elevated platform at a rail station. The trapdoor assembly also includes an extendible platform for bridging the gap between the railcar and the elevated station when the trapdoor is in the down position and the railcar is stopped at the elevated station.

19 Claims, 7 Drawing Sheets

(58) Field of Classification Search
CPC .. B61D 17/00; A61G 2003/067; A61G 3/061; A61G 3/06; B60R 3/02; B60P 1/431; B60P 1/433; B60P 1/43; B60P 1/4442; B60P 1/4471; B60P 1/4478; Y10S 414/134
See application file for complete search history.

(56) References Cited

U.S. PATENT DOCUMENTS

| | | | | | |
|---|---|---|---|---|---|
| 4,479,753 | A * | 10/1984 | Thorley | A61G 3/06 | 187/243 |
| 5,070,794 | A | 12/1991 | Kunst et al. | | |
| 5,252,904 | A * | 10/1993 | Nanos | H02P 23/24 | 318/484 |
| 6,263,804 | B1 * | 7/2001 | Rizk | B61D 23/02 | 105/329.1 |
| 2007/0059140 | A1 * | 3/2007 | Kiser | B60P 1/433 | 414/545 |
| 2011/0027054 | A1 * | 2/2011 | Hansen | A61G 3/061 | 414/523 |

* cited by examiner

HIGH LEVEL PLATFORM TRAPDOOR WITH BUILT IN MOVING SLIDE FOR RAILWAY PLATFORM GAP BRIDGING

PRIORITY CLAIM

This application claims priority to U.S. Provisional Patent Application No. 61/576,682, filed Dec. 16, 2011. The entire disclosure of the foregoing application is hereby incorporated herein by reference.

FIELD OF THE INVENTION

The present invention relates to the field of rail cars and in particular relates to the field of trapdoor mechanisms for allowing egress between a rail car and the platform at a rail station.

BACKGROUND

Train stations typically have either a ground level platform or a raised platform. At a raised platform, the platform is the same height as the passenger level of the rail car so the passengers can simply step onto the rail car from the platform. However, at a ground level platform, the passengers must climb steps from the platform to the passenger level to board the rail car.

Although elevated platforms are generally more accessible for individuals with a handicap, elevated platforms still have a gap of up to 15" that creates difficulties for those with limited mobility. Additionally, the gap provides a tripping hazard that frequently leads to slip and fall injuries.

To limit these problems rail system have implemented procedures to provide special assistance for passengers in wheelchairs. For wheelchair passengers some transit authorities use movable ramps that are stored in locked cabinets on the platform. A conductor has to unlock the security cabinet, fetch the device for use, and return it after use. This can cause vehicle schedule delays. For walking passenger safety from slip and fall accidents, some transit authorities have installed movable platforms at selected positions along the station platform that extend to the train car and provide a walking surface. This solution requires that the vehicle doors are registered to the position of the movable platforms when the train stops, which presents an operational challenge. Also, these movable platforms are hydraulically operated with large forces involved that can themselves cause injury if a passenger gets between the moveable platform and the train.

SUMMARY OF THE INVENTION

In light of the foregoing problems, the present invention provides a system for bridging the gap between a rail car and a platform. The system comprises a trapdoor assembly for a railcar having a deck and a flight of steps extending down from the deck. The assembly includes a top plate providing an upper surface for passengers to walk upon and an extendible slide operable between a first position in which the slide is retracted and a second position in which the slide projects outwardly from the top plate to provide a bridge for passengers to walk upon. The top plate is pivotable between an upright position and a horizontal position. A drive mechanism drives the slide from the first position to the second position. The system further includes a sensor for detecting a characteristic indicative of the slide being in the second position and a controller for controlling operation of the drive mechanism in response to the sensor.

DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 6:
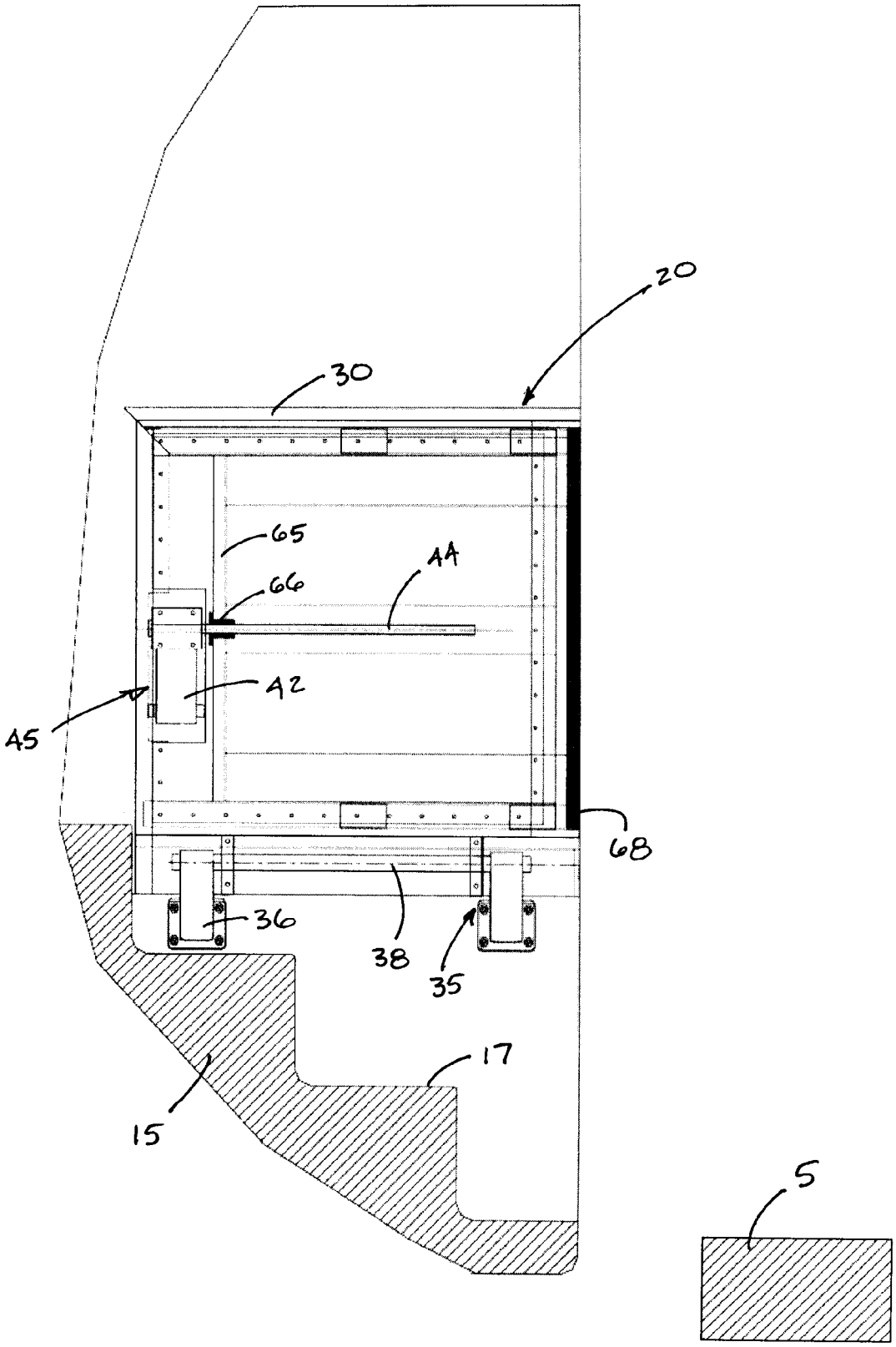
FIG. 6 is a side view partially in section of the trapdoor assembly illustrated in FIG. 5.

Referring now to the figures, a trapdoor assembly for a railcar 15 is designated 20. The assembly 20 is designed to allow passenger egress between the railcar 15 and a station platform at both ground level platforms and elevated platforms at rail stations. At a ground level platform 5, passengers climb or descend a flight of steps 17 between the passenger level of the railcar and the platform as shown in FIG. 6. At an elevated platform 10, the platform is elevated up to the height of the passenger level of the railcar 15, so the stairs 17 are unnecessary for egress between the train and the platform, as shown in FIG. 1.

To allow egress between the railcar and both group level and elevated stations, the trapdoor assembly 20 is pivotable between an up position and a down position. At a ground level platform, the trapdoor assembly 20 is pivoted upwardly, allowing egress via the stairs on the railcar 15. At an elevated platform, the trapdoor assembly 20 is pivoted downwardly to cover the stairs and allow egress by walking on the trapdoor assembly. Additionally, at an elevated platform, an extendible platform 60 extends from the trapdoor assembly 20 to bridge the gap between the railcar 15 and the elevated platform 10.

Figure 1:
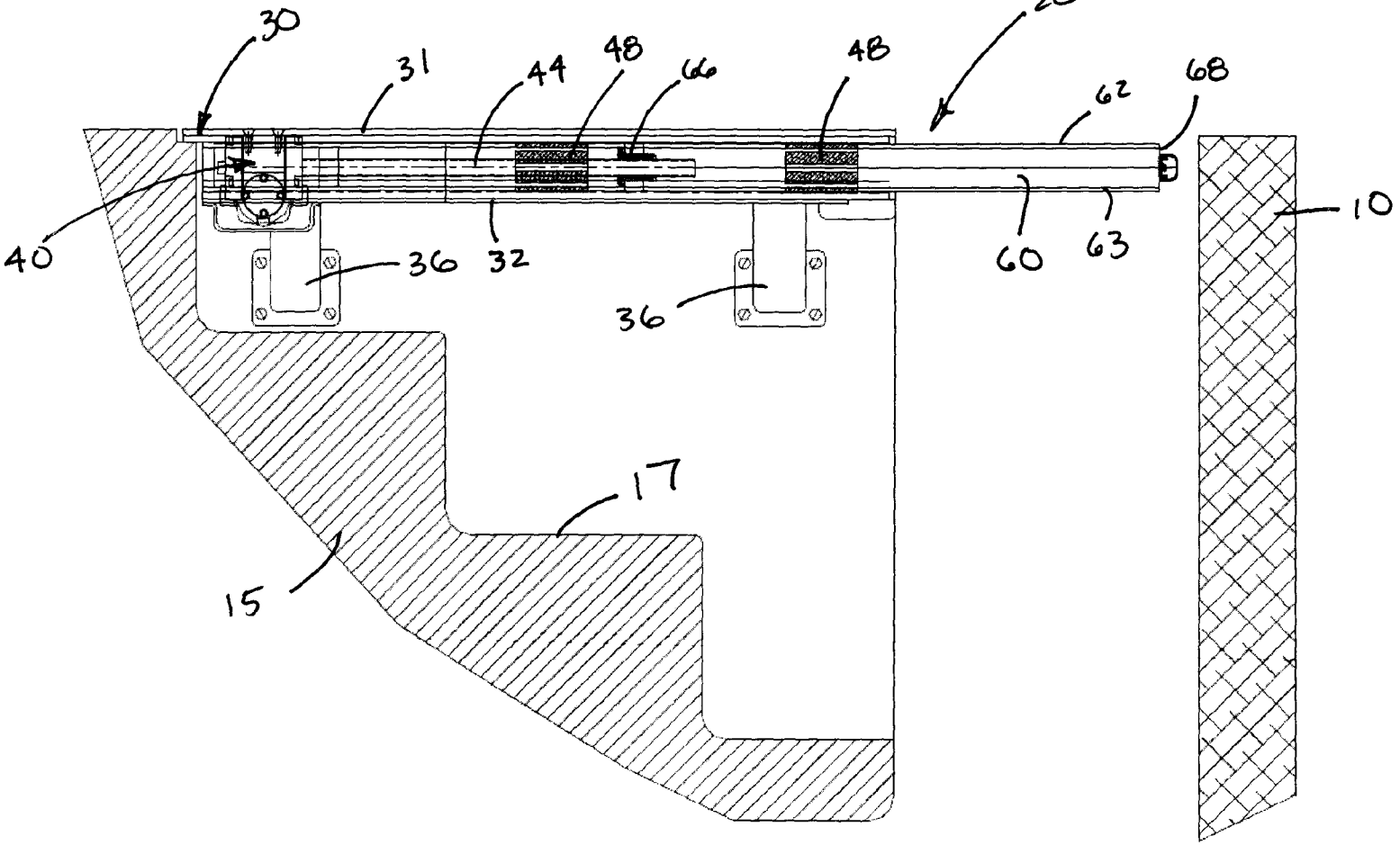
FIG. 1 is a side view partially in section of a trapdoor assembly having an extendible platform mounted on a railcar.
Figure 2:
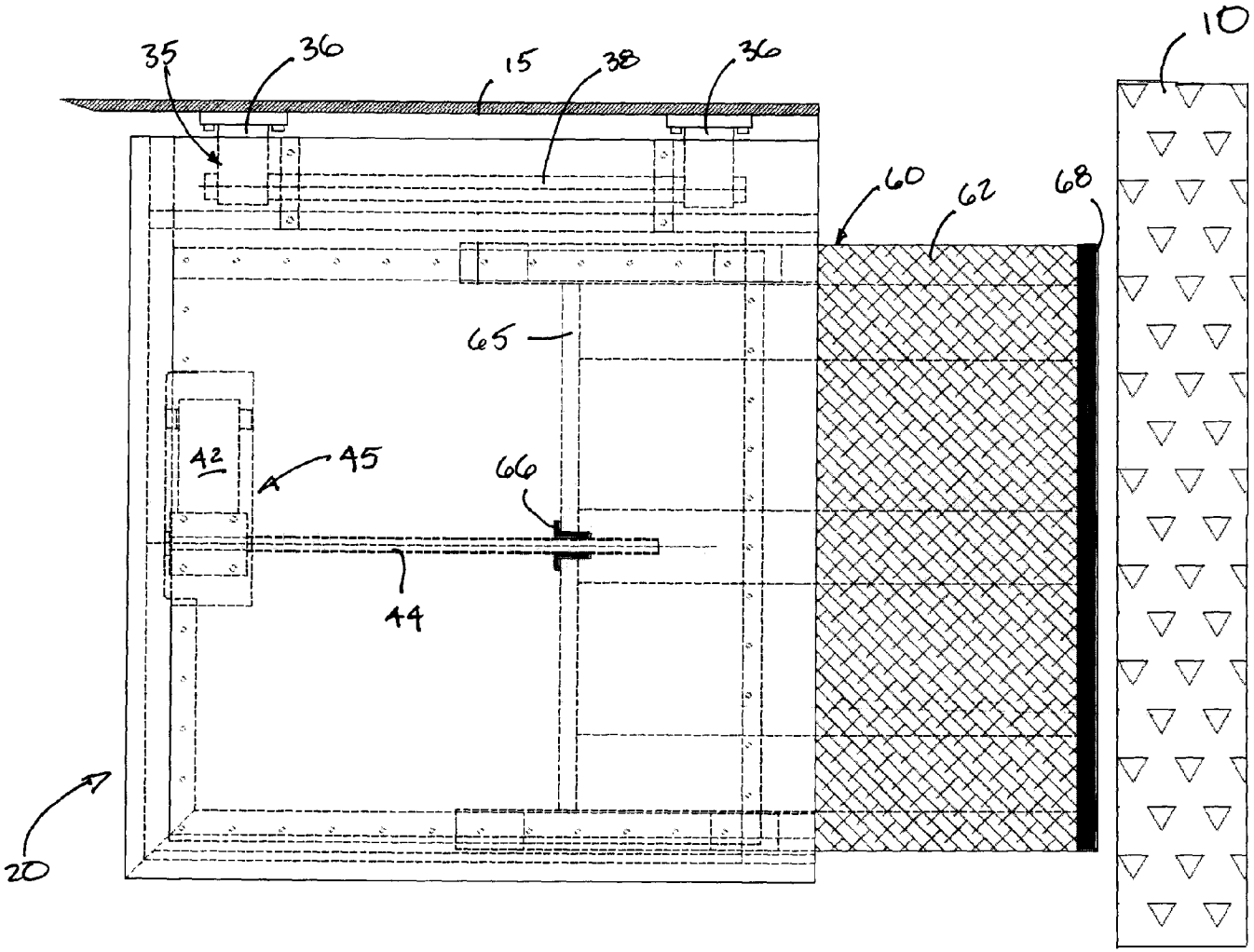
FIG. 2 is a plan view of the trapdoor assembly illustrated in FIG. 1.

Referring now to FIGS. 1-2, the trapdoor assembly 20 comprises a pivotable trapdoor 20, the extendible platform 60 and a drive mechanism 40 for driving the extendible platform between an extended position and a retracted position. The pivotable platform 30 is pivotable about a pivot mechanism 35, so that the trapdoor and attached extendible platform can be pivoted between an up position and a down position. A controller 80 (FIG. 7) controls operation of the drive mechanism 40 in response to one or more sensors.

The trapdoor 30 provides a platform for covering the stairs 17 when the railcar 15 is at an elevated platform. The trapdoor 30 may be any of a variety of configurations, including a generally flat plate formed of material having sufficient rigidity to support the weight of passengers when the passengers walk on the trapdoor. In the present instance, the trapdoor 30 comprises a box-shaped frame having a top face 31 and a bottom face 33 connected by sides 32. The top and bottom faces 31, 33 are generally flat planar faces formed of rigid material, such as steel or aluminum, so that the trapdoor has sufficient rigidity to support the weight of passengers. However, it should be understood that the top and bottom faces can be formed of other materials, such as plastic or composite materials. The top face 31 provides an upper surface on which passengers walk when the assembly 20 is pivoted into the down position. Accordingly, in the present instance, the top face 31 comprises a textured surface to impede slippage. For instance, the top face 31 may be formed of an anti-slip metal plate, commonly referred to as diamond plate.

Figure 3:
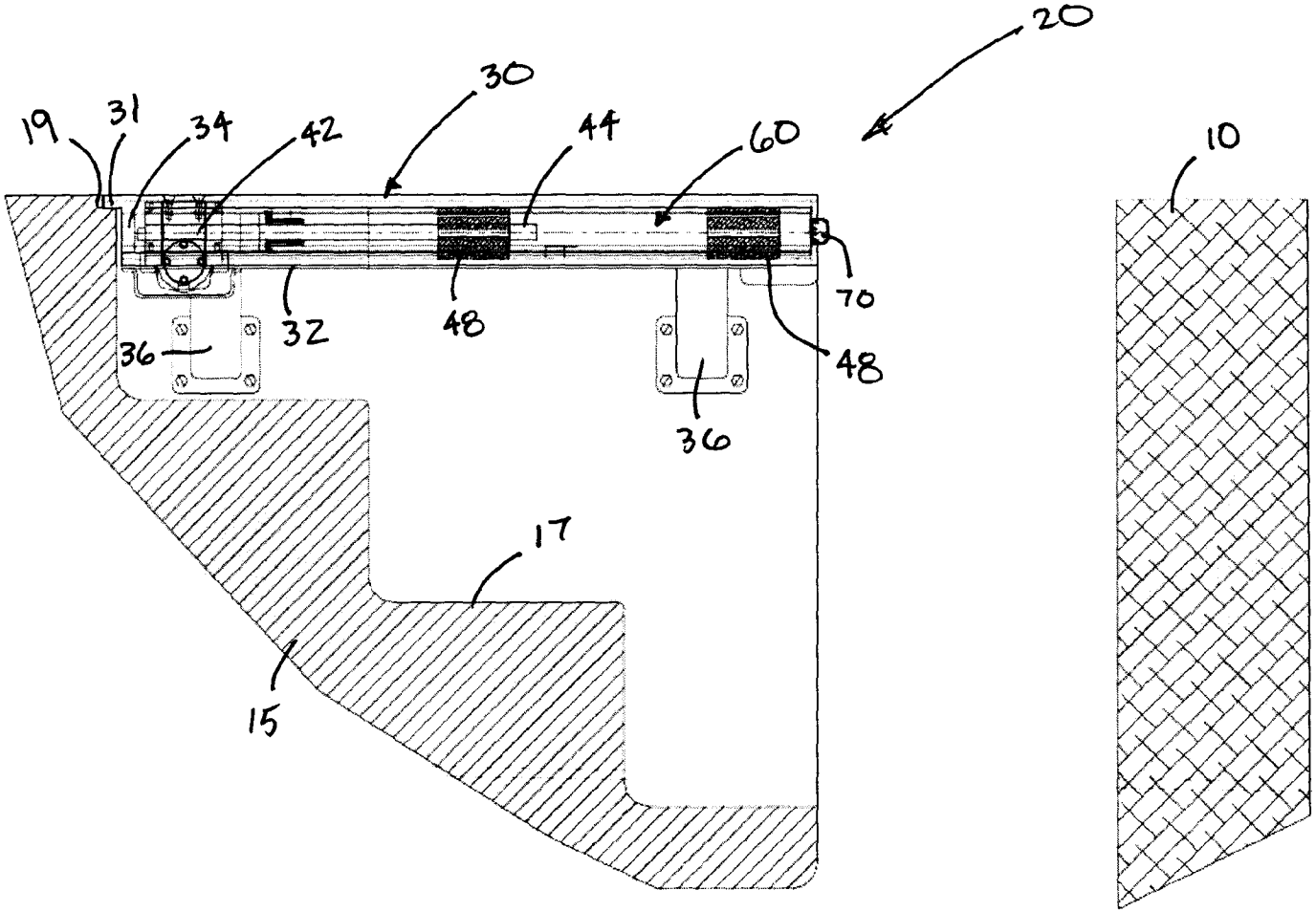
FIG. 3 is a side view partially in section of the trapdoor assembly illustrated in FIG. 1 with the extendible platform in a retracted position.

The bottom face 33 is substantially parallel to the top face 31. The sides 32 connected the top face 31 with the bottom face to provide a rigid box frame. The top face 31 projects outwardly beyond the sides 32 forming a lip. As shown in FIGS. 3 and 6, the lip engages a rim 19 at the top of the stairs that supports the rim of the trap door when the trapdoor is pivoted into the down position. The lip also acts as a stop limiting the displacement of the trapdoor when the trapdoor is pivoted down. A back 34 encloses the rearward side of the box frame, while the forward end of the box frame remains open. In this way, the box frame forms a rigid box having a pocket for housing the extendible platform 60 and the drive mechanism 40.

As noted above, the trapdoor 30 provides a platform for covering the stairs 17 when the railcar 15 is at an elevated platform. When the railcar is at a ground level platform, the trapdoor is pivoted out of the way so that passengers can use the steps 17 on the train to climb onto the train or to descend to the platform. Accordingly, a pivot mechanism 35 allows the trap door to pivot between the up position illustrated in FIGS. 1-2 and the down position illustrated in FIGS. 5-6.

The pivot mechanism comprises a pair of mounting arms 36 for rigidly connecting the trapdoor assembly 20 to the railcar 15. For instance, the mounting arms 36 may include a plurality of holes for bolting the mounting arms to the body or frame of the railcar 15. Alternatively, the mounting arms 36 may be welded or otherwise permanently affixed to the body or frame of the rail car. In the present instance, the mounting arms are formed of a strong rigid material, such as steel or other metal.

Figure 4:
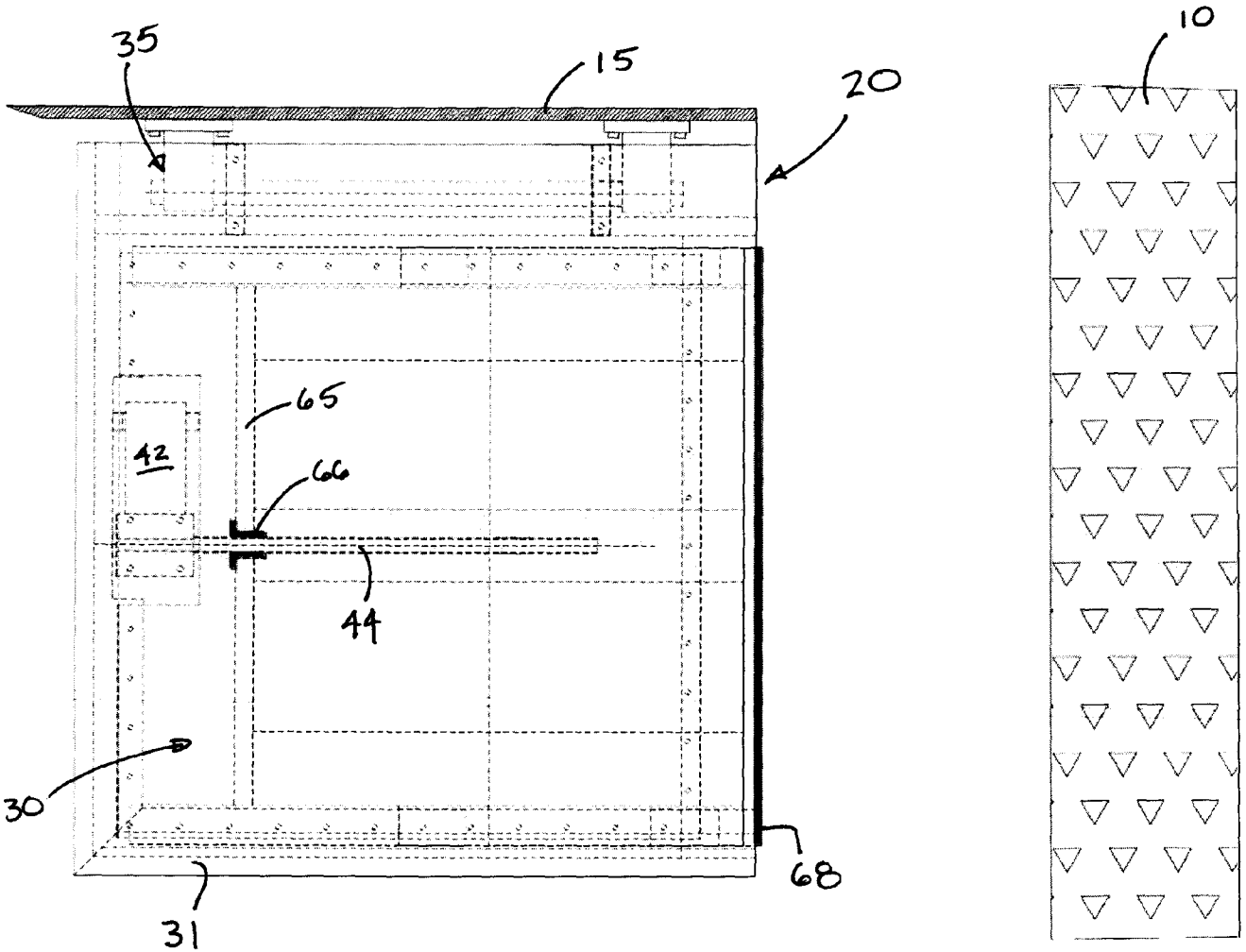
FIG. 4 is a plan view of the trapdoor illustrated in FIG. 3.

A pivot rod 38 extends between the mounting arms 36 as shown in FIGS. 2 and 4. The pivot rod 38 is connected with the trapdoor 30 so that the trap door is pivotable about the pivot rod. Accordingly, the pivot rod 38 may be journaled within the mounting arms and rigidly connected with the trapdoor. Alternatively, the pivot rod 38 may be rigidly connected with the mounting arms 36 and rotatably connected with the trapdoor 30 so that the trapdoor rotates relative to the pivot rod. A further option would be to use two hinged pins to provide a pivoting connection between the trapdoor and the railcar. Additionally, the pivot mechanism 35 may include a lift element to lift the trapdoor from the down position to the up position. For instance, the pivot mechanism may include a biasing element, such as a torsion spring operable to provide a biasing force that rotates the trapdoor toward the up position. Accordingly, in the present instance, the trapdoor 35 comprises a releasable locking mechanism, such as a latch, that cooperates with a mating locking mechanism on the railcar to releasably lock the trapdoor in the down position. Similarly, the trapdoor comprises a releasable locking mechanism that cooperates with a mating locking mechanism on the railcar to releasably lock the trapdoor in the up position. The locking mechanism on the trapdoor can be formed so that the same mechanism can be used to lock the trap door in the up and down positions. Alternatively, the trapdoor may include a first locking mechanism for locking the trapdoor in the up position and a second locking mechanism for locking the trapdoor in the down position.

As discussed above, the assembly 20 includes an extendible platform 60 designed to extend outwardly from the trapdoor 30 to bridge the gap between the railcar 15 and the station platform when the railcar is stopped at an elevated platform 10, as shown in FIGS. 1-2. The extendible platform 60 may be any of a variety of shapes, including a foldable or hinged platform. However, in the present instance, the platform is a rigid generally planar platform that nests within the pocket in the trapdoor 30. Referring to FIGS. 1-2, the extendible platform 60 comprises a top surface 62 that is substantially planar. Additionally, like the top face 31 of the trapdoor 30, the top surface 62 of the extendible platform 60 is formed of a rigid material having an anti-slip surface. For instance, in the present instance, the top surface 62 of the extendible platform is formed of metal diamond plate.

The extendible platform 60 also comprises a substantially planar bottom surface 63 that is generally parallel to the top surface 62. Front wall 68, rear wall 65 and sidewalls connect the top and bottom surfaces 62, 63 forming a closed rigid box frame having sufficient rigidity to support the weight of passengers. Additionally, as discussed below, in the extended position, the extendible platform projects outwardly from the trapdoor 30 and the outer edge of the extendible platform may not be supported. In this way, as shown in FIG. 1, the extendible platform forms a cantilever beam. Accordingly, the extendible platform 60 is formed of material to support the weight of passengers under cantilever beam loading conditions.

The extendible platform 60 is driven between the extended position and retracted position by the drive mechanism 40. Any of a variety of drive mechanisms can be utilized to drive the extendible platform 60, including, but not limited to hydraulic, pneumatic, solenoid or motor driven sliding drive arms and belts, cables, chains or wheels driven by a motor. However, in the present instance, the drive mechanism comprises a threaded drive screw 44 driven by a motor 42. The drive screw 44 threadedly engages a threaded insert 66 rigidly connected with the extendible platform. Specifically, the threaded insert 66 is an internally threaded collar connected with and extending through the rear wall 65 of the extendible platform 60. As shown in FIGS. 1-6, the drive screw 44 extends from the drive motor 42 through the threaded insert 66 and into the interior of the extendible platform 60.

Driving the motor in a first direction rotates the drive screw 44 in the first direction, which thereby drives the extendible platform 60 forwardly. In this way, driving the motor in the first direction drives the platform 60 from the retracted position shown in FIGS. 3-4 toward the extended position shown in FIGS. 1-2. Rotating the motor in a second direction drives the drives screw 44 in the reverse direction, thereby driving the platform 60 in a rearward direction. In this way, driving the motor in the second direction drives the platform 60 from the extended position shown in FIGS. 1-2 toward the retracted position shown in FIGS. 3-4 in which the platform 60 is nested within the trapdoor 30.

In the present instance, the assembly 20 further includes guide blocks that support and guide the extendible platform 60 as the platform is displaced between the extended and retracted positions. For instance, referring to FIGS. 1, 3 and 5, the assembly may comprise guide blocks 48 formed on sides of the platform. The guide blocks 48 may includes ridges or slots that cooperate with mating ridges or slots along the inside edges of the trapdoor 30 to guide the platform as it is driven between the extended and retracted positions. In particular, the guide blocks 48 guide the platform to impede the platform from skewing or tilting relative to the trapdoor as the platform is extended and retracted. The guide blocks 48 also support the edges of the extendible platform. In this way, the guideblocks 48 limit the transverse forces applied to the drivescrew 44.

Figure 7:
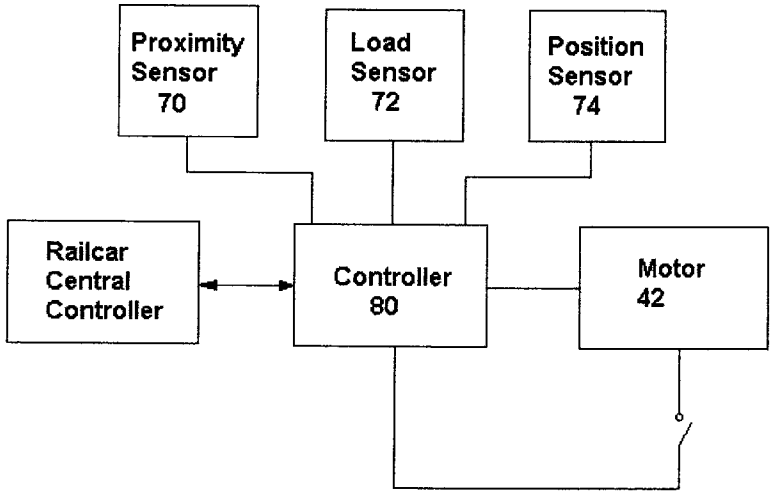
FIG. 7 is a diagrammatic interconnect drawing illustrating various electrical connections.

Referring to FIGS. 1 and 7, the assembly 20 further comprises a controller 80 for controlling operation of the extendible platform 60. The controller 80 located in a housing within the interior of the trapdoor 30. However, in the present instance, the controller 80 is in a housing remote from the trapdoor 30 mounted on the railcar and interconnected with the dc power supply of the railcar.

The controller 80 controls the platform 60 in response to one or more sensors. The sensors may be designed to detect a characteristic indicative of whether the leading edge 68 of the extendible platform 60 is adjacent an elevated platform 10 at a rail station. For instance, the assembly 20 may include a proximity sensor 70 mounted in the leading edge 68 of the extendible platform. The proximity sensor 70 may be recessed into the extendible platform behind a rubber cover so that the sensor does not contact the elevated platform even if the extendible platform is driven into contact with the elevated platform. The proximity sensor may be any of a variety of sensor configured to detect whether the sensor is within a predetermined distance of a nearby object. In this way, the proximity sensor detects whether the leading edge of the extendible platform is within a predetermined distance of a wall of an elevated platform when the railcar is stopped at a station. Although a single proximity sensor may be used, preferably a plurality of proximity sensors are position along the width of the extendible platform, recessed within the leading edge 68. The proximity sensors 70 provide signals to the controller 80 indicative of whether the leading edge of the extendible platform is within a predetermined distance of the elevated platform 10.

Additionally, the assembly 20 may include a load sensor 72 connected with the motor 42 that detects the electrical load on the motor. If the extendible platform 60 is driven into contact with an object, such as the station platform or other object such as a passenger limb, the load on the motor will increase as the extendible platform pushes against the object. The load sensor 72 provides a signal to the controller indicative of the electrical load on the motor, which is indicative of whether the leading edge of the extendible platform is adjacent an elevated platform or other object. For instance, the load sensor may be a current sensor or load detection circuit, such as a current limiting circuit.

The assembly 20 may also include a position sensor 74 for detecting displacement of the extendible platform 60. For instance, the position sensor 74 may be connected with the motor to detect the rotational displacement of the 42. The displacement of the extendible platform is directly related to the rotational displacement of the motor 42. Therefore, detecting the rotation of the motor can be used to monitor the displacement of the extendible platform. Alternatively, a position sensor may be used that directly monitors the position of the extendible platform. A variety of sensors can be used to monitor the displacement of the platform, and in the present instance, the position sensor 74 is a magnetic pulse sensor that detects the rotation of the motor 42. The sensor provides a signal each time the motor makes a revolution. The controller monitors the signals from the position sensor 74 to determine the number of revolutions the motor made when displacing the platform 60. Each revolution of the motor relates to a specific displacement of the platform, so the controller can determine the displacement of the platform by multiplying the number of detected revolutions of the motor by the displacement per revolution.

The controller 80 may also receive an input from a central controller on the railcar or an input mechanism on the railcar. For instance, the railcar may include a central controller programmed with information regarding the various stations along the train route and the position of the railcar. The central controller of the railcar may be connected with the assembly 20 so that the controller receives signals from the central controller of the railcar. In this way the railcar central controller may provide a signal to the controller 80 indicative of whether the railcar is at a station having an elevated platform. The central controller of the railcar may also provide a signal to the controller 80 indicative of whether the railcar is moving or stopped. If the controller receives a signal from the railcar central controller indicating that the railcar is stopped at a station having an elevated platform, the controller may control operation of the motor 42 to drive the motor forwardly to extend the extendible platform 60.

Alternatively or additionally, the controller 80 may be connected with one or more input mechanisms on the railcar so that the controller receives an input signal from one or more input mechanism on the railcar. For instance, when the railcar is stopped at a station having an elevated platform, an operator may actuate an input device, such as a button, indicating that the railcar is stopped at an elevated platform. Actuation of the button provides a signal to the controller 80 indicating that the railcar is stopped at a station having an elevated platform. In response, the controller 80 may control operation of the motor to drive the extendible platform toward the extended position. Similarly, before leaving the platform, the operator may press a button which sends a signal to the controller 80 indicating that the railcar is about to move. In response, the controller 80 may control operation of the motor 42 to drive the motor in the reverse direction to retract the platform 60 into the trapdoor 30.

The controller 80 can control the operation of the drive motor 42 in response to one or all of the sensors described above. For instance, once receiving a signal indicating that the railcar is stopped at a station having an elevated platform, the controller may control the motor 42 to drive the platform 60 forwardly until the controller receives a signal from one of the proximity sensors 70 indicative of the leading edge of the extendible platform being adjacent the elevated platform. Once the controller 80 receives such a signal from the proximity sensor 70, the controller may stop the motor, thereby stopping the platform in an extended position.

Alternatively, the controller 80 may control the motor 42 in response to feedback from the drive sensor 72. Once receiving a signal that the railcar is stopped at a station having an elevated platform, the controller may cause the motor to drive forwardly until the controller receives a signal from the drive sensor indicative of a load above a predetermined threshold, indicating that the platform is against the elevated platform. Once the controller receives such a signal from the drive sensor, the controller may stop the motor, thereby stopping the platform in an extended position.

As still yet another alternative, the controller 80 may control the motor in response to feedback from the position sensor 74. Once receiving a signal that the railcar is stopped at a station having an elevated platform, the controller may cause the motor to drive forwardly until the controller receives a signal (or signals) from the position sensor 74 indicative of the platform 60 having been displaced by a predetermined distance corresponding to an extended position. Once the controller receives such a signal (or signals), the controller may stop the motor, thereby stopping the platform in an extended position.

Although the controller 80 may control the motor in response to signals from one of the sensors as described above, in the present instance, the controller controls the motor in response to signals received from both the proximity sensor(s) 70 and the drive sensor 74. Specifically, when the railcar is stopped at a station having an elevated platform, the controller 80 controls the motor 42 by driving the motor forwardly until receiving a signal from either the proximity sensor 70 or drive sensor 72. For instance, the controller may control the motor to drive the platform 60 forwardly until one of the proximity sensors 70 detects that the leading edge is adjacent an object. The controller may then stop the motor to stop the extendible platform in an extended position. However, if a passenger limit or other objects is in the gap, the drive sensor 72 may detect an increased load on the motor 42 before the proximity sensor detects that the leading edge 68 of the platform 60 is adjacent the elevated platform of the station. In response to receiving a signal from the drive sensor 72 indicative of the extendible platform 60 contacting an object, the controller may stop the motor 42. Alternatively, in the present instance, when receiving such a signal, the controller reverses the motor to retract the platform away from any object that the platform may have been contacting. In this way, the drive sensor 72 can operate as a safety switch to ensure that objects do not get crushed between the extendible platform 60 and the station platform.

Figure 5:
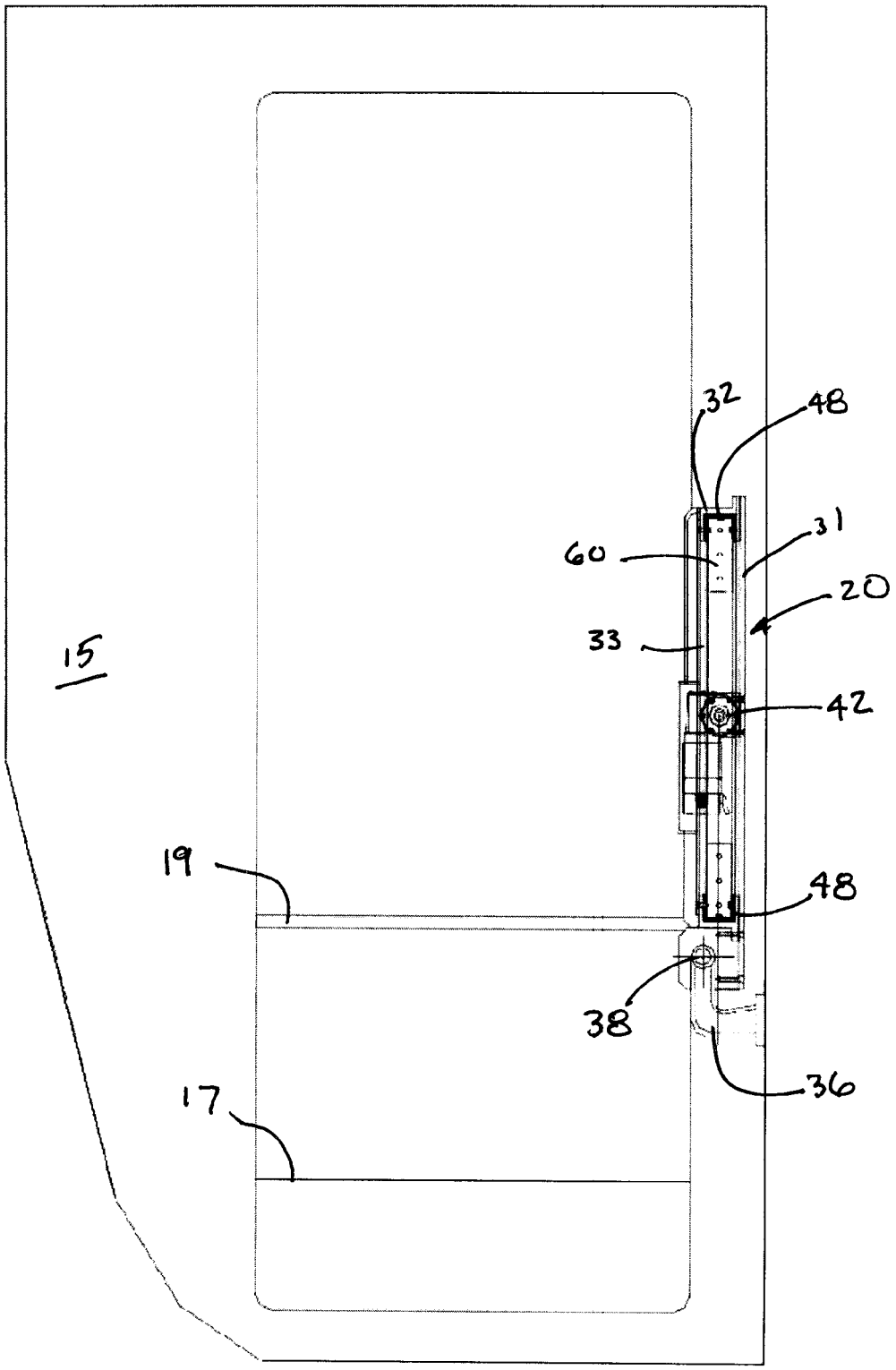
FIG. 5 is a front view of the trapdoor assembly illustrated in FIG. 1 pivoted into an open position.

The assembly may also include a safety to prevent the platform 60 from extending when the trapdoor 30 is in the upright position as shown in FIG. 5. For instance, the assembly 20 may include a switch wherein a contact of the switch is configured so that the switch is open when the trapdoor is in the upright position. The switch may be connected with the power supply for the assembly so that when the switch is open, no power is provided to the platform assembly so that the motor cannot be driven. Alternatively, the switch may provide a signal to the controller 80 indicative of whether the trapdoor assembly 20 is pivoted up or down and the controller may control operation of the motor to ensure that the motor is not actuated if the trapdoor assembly is pivoted up.

As noted above, the controller 80 may control the motor 42 in response to feedback from the position sensor 74. Additionally, the position sensor may be used to monitor variation in track position. Over time, tracks may shift. It is desirable to monitor the track movement over time. Accordingly, by monitoring the distance between the railcar and a platform, movement of the tracks can be monitored. As described above, the position sensor 74 detects the distance the extendible platform moves when the platform is extended. Over time, as the tracks move, the distance between the railcar and the platform will change, so the distance the platform extends will change. Therefore, in the present instance, the system comprises a non-volatile storage medium for storing the data regarding the distance the platform extends at the station. The system also includes a mechanism for connecting the storage medium so that the data can be downloaded and analyzed by a separate computing device, such as a personal computer or other device. By analyzing the travel data for the extendible platform at each station, the movement of the tracks can be monitored over time.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A trapdoor assembly for a railcar having a deck and a flight of steps extending down from the deck, wherein the trapdoor assembly comprises:

a top plate providing an upper surface for passengers to walk upon;

an extendible slide operable between a first position in which the slide is retracted and a second position in which the slide projects outwardly from the top plate to provide a bridge for passengers to walk upon;

a drive mechanism operable to drive the slide from the first position to the second position;

a sensor for detecting a characteristic indicative of the slide being in the second position;

a controller for controlling operation of the drive mechanism in response to the sensor;

a non-volatile memory for storing data;

wherein the top plate is pivotable about a pivot axis between an upright position and a horizontal position and the extendible slide is connected with the top plate so that the extendible slide pivots between the upright position and the horizontal position with the top plate;

wherein the slide comprises an outer edge and the sensor is a proximity sensor operable to detect the proximity of the slide to an elevated train platform;

wherein the slide is displaced a distance when the slide is displaced from the first position to the second position and the assembly comprises a second sensor for detecting the distance; and wherein the non-volatile memory is operable to store data regarding the detected distance that the slide is displaced.

2. The assembly of claim 1 wherein when the assembly is mounted onto a railcar, in the horizontal position the top plate is configured to cover the flight of steps and provide a surface for supporting passenger egress and in the vertical position the top plate is configured to provide access to the flight of steps.

3. The assembly of claim 1 comprising a hinge for pivoting the top plate between the upright position and the horizontal position.

4. The assembly of claim 1 wherein the drive mechanism comprises a motor and the controller comprises a processor operable to control power to the motor in response to the sensor.

5. The assembly of claim 4 wherein the drive mechanism comprises a rotatable drive screw and the motor is operable to drive the drive screw in a forward direction to drive the slide outwardly from the first position to the second position and a reverse direction to drive the slide inwardly from the second position to the first position.

6. The assembly of claim 4 comprising a load sensor for detecting the load on the motor, wherein the controller is operable to automatically control the motor in response to the detected load on the motor.

7. The assembly of claim 6 wherein the controller is operable to automatically reverse the motor when the load on the motor exceeds a threshold load.

8. The assembly of claim 1 comprising a switch for disconnecting power to the drive mechanism when the top plate is in the upright position to ensure that the extendible slide does is not displaced when the platform is stowed in the upright position.

9. A railcar having a passenger deck and an exit having a flight of stairs extending down from the deck and a trapdoor assembly mounted adjacent the flight of stair, wherein the trapdoor assembly comprises:

a pivotable platform;

a hinge connected with the railcar and the pivotable platform so that the pivotable platform is pivotable about a pivot axis between an upward position and a downward position, wherein in the upward position the pivotable platform is pivoted away from the stairs to provide passenger egress via the stairs and in the downward position the pivotable platform is pivoted over the stairs to overlie the stairs and provide a surface for passengers to walk upon;

an extendible platform operable between a first position in which the extendible platform is retracted and a second position in which the extendible platform projects outwardly from the pivotable platform to provide a bridge extending from the pivotable platform for passengers to walk upon when the pivotable platform is pivoted into the downward position wherein the extendible platform is connected with the pivotable platform so that the extendible platform pivots between the upright position and the horizontal position with the pivotable platform;

a drive mechanism operable to drive the extendible platform from the first position to the second position;

a sensor for sensing the proximity between an outer edge of the extendable platform and a station platform;

a controller for controlling operation of the drive mechanism in response to the sensor; and a non-volatile memory for storing data;

wherein the extendible platform is displaced a distance when the extendible platform is displaced from the first position to the second position and wherein the trapdoor assembly comprises a second sensor for detecting the distance;

wherein the non-volatile memory is operable to store data regarding the detected distance that the slide is displaced.

10. The assembly of claim 9 wherein the drive mechanism comprises an electric motor.

11. The assembly of claim 9 wherein the drive mechanism comprises a motor and the controller comprises a processor operable to control power to the motor in response to the sensor.

12. The assembly of claim 9 wherein the drive mechanism comprises a rotatable drive screw and the motor is operable to drive the drive screw in a forward direction to drive the extendible platform outwardly from the first position to the second position and a reverse direction to drive the slide inwardly from the second position to the first position.

13. The assembly of claim 11 comprising a load sensor for detecting the load on the motor, wherein the controller is operable to automatically control the motor in response to the detected load on the motor.

14. The assembly of claim 13 wherein the controller is operable to automatically reverse the motor when the load on the motor exceeds a threshold load.

15. The assembly of claim 9 comprising a switch for disconnecting power to the drive mechanism when the pivotable platform is in the upward position to ensure that the extendible slide does is not displaced when the platform is stowed in the upright position.

16. The assembly of claim 8 comprising a lock for locking the extendible slide in the upright position.

17. The assembly of claim 15 comprising a lock for locking the extendible slide in the upright position.

18. The assembly of claim 1 wherein the top plate extends over the pivot axis when the top plate is in a horizontal position.

19. The assembly of claim 9 wherein in the downward position the pivotable platform overlies the pivot axis.

* * * * *